United States Patent [19]

Hayes, Jr.

[11] Patent Number: 4,795,052

[45] Date of Patent: Jan. 3, 1989

[54] SPILL-PROOF LID

[76] Inventor: George W. Hayes, Jr., P.O. Box 764, Suquamish, Wash. 98392

[21] Appl. No.: 88,860

[22] Filed: Aug. 24, 1987

[51] Int. Cl.[4] ..... A47H 12/22; B65D 21/02

[52] U.S. Cl. ..... 220/90.4; 220/369; 220/374

[58] Field of Search ..... 220/90.2, 90.4, 254, 220/369, 373, 374; 206/508; 229/7 R

[56] References Cited

U.S. PATENT DOCUMENTS

| | | | |
|---|---|---|---|
| 2,099,292 | 11/1937 | Brown . | |
| 3,360,161 | 12/1967 | Smith . | |
| 3,739,938 | 6/1973 | Paz . | |
| 3,915,355 | 10/1975 | Young . | |
| 4,018,355 | 4/1977 | Ando | 220/90.4 |
| 4,322,014 | 3/1982 | Philip . | |
| 4,394,928 | 7/1983 | Philip . | |
| 4,582,214 | 4/1986 | Dart et al. | 220/90.4 |
| 4,671,406 | 6/1987 | Baer | 220/90.4 |

*Primary Examiner*—Joseph Man-Fu Moy

*Attorney, Agent, or Firm*—Christensen, O'Connor, Johnson & Kindness

[57] ABSTRACT

A spill-proof lid for use with a container for liquids includes a liquid chamber that has an outlet opening above and an inlet opening below the plane of the lid and a vent chamber, which has an inlet above and an outlet below the level of the lid. Each chamber's outlet and inlet ends are adjacent one another. However, the outlet and inlet ends of the vent chamber are on an opposite edge of the lid from the outlet and inlet ends of the liquid chamber. The chambers are constructed so that, as they extend from inlet to outlet, they traverse the lid from edge to axially opposing edge and back again. The periphery of the lid is constructed to sealingly engage the upper edge of the container. Preferably, the inlet end of the vent and the outlet end of the liquid chamber have mouthpieces formed thereon for ease of drinking. In one embodiment of the lid, the liquid and vent chambers are concentric single-loop helixes.

17 Claims, 2 Drawing Sheets

SPILL-PROOF LID

BACKGROUND OF THE INVENTION

This invention relates to lids to cover containers for liquids, such as glasses and cups, and, more particularly, relates to a lid that prevents accidental spillage of the liquid within the container while allowing a person to drink the liquid from the container without removal of the lid.

When liquids, such as coffee, tea, juice, and the like, are carried in cups or glasses in moving vehicles, such as airplanes, trains, buses, or cars, the irregular movement of the vehicle often causes the liquid to jiggle and splash within the container. The jiggling and splashing can cause the liquid to spill out of the container and over the hands and clothing of the person using the container or over the clothing of persons in the vicinity of the user. Also, if the container is set down by the user while the vehicle is moving, the motion of the vehicle may tip the container over, spilling the contents of the container.

Many attempts have been made to provide a container and cover for preventing the splashing and spilling of liquids for use in moving vehicles; however, such attempts have resulted in cups, containers, and covers that are expensive to produce, difficult and cumbersome to use, and typically provide that the container and cup be made to accommodate one another so that a universal lid for use on many different types of containers has not been produced. An example of a container lid that attempts to solve the splashing problem is shown in U.S. Pat. No. 4,394,928, issued July 26, 1983 to Morris Philip. The Philip lid addresses the problem of splashing of the liquid while the cup is in a vertical position; however, it does not address the problem of spillage of the liquid when the cup is tilted sideways. In fact, the Philip lid is designed to allow flow of liquid when the cup is tilted sideways. Also, the disclosure in Philip describes a cover and container that are constructed to cooperate with one another so that the cover can only be used on the matching container and is not a universal cover for use with many different types of containers. Likewise, the covers shown in U.S. Pat. Nos. 4,322,014 and 3,915,355 also deal with the splashing problem but not the problem of spilling of the liquid from the container when the container is in a horizontal position.

It is, therefore, an object of the present invention to provide a lid for a container to prevent spilling of liquid from the container when the container is in a horizontal or even inverted position and to prevent splashing of the liquid from the container when the container is in a vertical position.

Another object of the invention is to provide such a lid that is able to be used with standard containers and does not need a customized container to be adapted to it.

Another object of the invention is to provide such a lid that is relatively simple and inexpensive to manufacture.

SUMMARY OF THE INVENTION

In accordance with the above-stated objects, the present invention provides a spill-proof lid for use with a container for liquids. The lid includes a cover plate for covering the open end of the container. The periphery of the plate is constructed to sealingly engage the upper edges of the walls of the container in a conventional manner to provide a spill-proof attachment between the lid and the container. The lid includes a first liquid chamber that has an inlet end that opens below the lower surface of the plate so that it is in fluid communication with the interior of the container and an outlet end that opens above the upper surface of the plate so that it is in fluid communication with the environment outside the container. The inlet and outlet of the liquid chamber are closely adjacent one another and located near an edge of the plate. As the chamber extends from the inlet to the outlet it traverses the lid to a point near an opposite edge of the lid, axially opposed to the location of the inlet and then traverses the lid again to the outlet. The chamber can follow a curvilinear path to improve user comfort and lid function. The lid also includes a vent chamber that has an inlet end in communication with the environment outside the container and an outlet end that is in communication with the interior of the container. The inlet and outlet of the vent chamber are also located adjacent one another but are on an opposite edge of the plate from the inlet and outlet of the liquid chamber. The path that the vent chamber follows as it extends between its inlet and outlet runs from the inlet to a point on the edge of the plate opposite the inlet and back to the outlet.

The operation of the cup and lid is such that the basic plate provides splash protection when the cup is in the upright position. When the cup is tilted in the direction of the inlet of the liquid chamber, liquid moves toward the lid and the inlet of the liquid chamber. The liquid enters the inlet of the liquid chamber and rises up the chamber. Due to the liquid seeking its own level, the fluid rises in the chamber only until it is at the same level with the liquid in the container. The fluid cannot rise above this level until the user applies a suction with his mouth. The user places his mouth over the outlet opening of the liquid chamber and produces a suction of the chamber much like drinking with a straw. The liquid is moved through the chamber from the inlet to the outlet by the suction applied by the user. At the same time, air from outside the container enters the vent chamber inlet and prevents a vacuum from forming within the container. When the cup is tipped over with no suction being applied by the user, for example, if it is accidentally knocked over, liquid may fill a portion of either or both the vent chamber and the liquid chamber; however, the liquid in either chamber will not rise above the level of liquid in the cup and will not reach the other ends of the chamber. With violent shaking, a few drops of liquid may be forced out, but no more.

The design continues to be spill-proof even when the container is inverted. As the container is tipped, the fluid level rises up the inlet side of the liquid chamber, maintaining the same level as the level of the liquid in the container. As the container passes the horizontal position, the air within the container rises to the container bottom, which is now at a level above the lid. Once the liquid has risen in the container sufficiently to cover the lid's lower surface and partly fill the liquid chamber, the liquid will still not exit the container, since the vent will also be blocked by liquid and atmospheric pressure will keep the liquid locked in the container.

Preferably, in one embodiment of the lid, the liquid chamber is larger than the vent chamber. In the illustrated embodiment, the liquid chamber is a single-loop helix that descends from the outlet to the inlet with the container in an upright position and the vent chamber is a similar single-loop helix, concentric with the liquid chamber, that also descends downwardly from the vent inlet to the vent outlet with the cup in the upright position. The reason for using the ramped configuration is to eliminate inconveniences present if the chambers are formed in a flat plane. If a user tips the container and draws on the liquid chamber outlet, extracting liquid from the container, and then stops drinking and tilts the cup upright, a certain amount of liquid is held in the chamber by surface tension at the inlet. As the user then tips the cup to drink again, the trapped liquid in the chamber can dribble out the outlet before the user gets the cup to his mouth. In order to cure this inconvenience, the chamber is designed with a "downhill" component so that each time the user tips the container back to an upright position after drinking, the liquid will drain out of the chamber and into the container.

Another potential inconvenience addressed by the illustrated embodiment is one most likely to be encountered with the lid used by an infant or young child. With certain configurations of the chambers, a siphon can accidentally be created by sucking liquid through the chamber and taking the container away from the mouth without righting the container. The single-loop helix with its "downhill" component is one configuration that prevents the accidental siphon effect by forcing the liquid to return to the container whenever suction is removed.

BRIEF DESCRIPTION OF THE DRAWINGS

The spill-proof lid of the present invention will be better understood by those of ordinary skill in the art and others upon reading the ensuing specification, when taken in conjunction with the appended drawings, wherein.

DETAILED DESCRIPTION OF A PREFERRED EMBODIMENT

Figure 1:
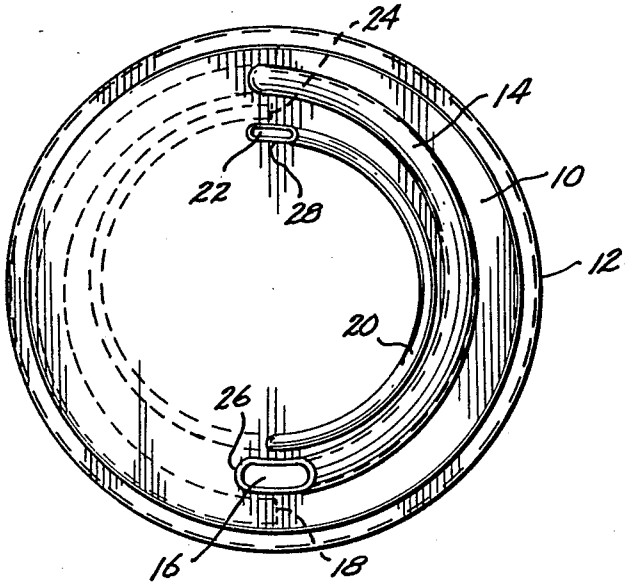
FIG. 1 is a top plan view of one embodiment of a lid made in accordance with the principles of the present invention.

FIG. 1 shows one embodiment of a spill-proof lid for a container of liquid made in accordance with the principles of the present invention. The lid includes a disk-shaped plate 10 that has an outer periphery 12 formed in a conventional manner so that it is capable of sealingly engaging the upper edge of the wall of a conventional cylindrical cup or glass. The lid also includes a liquid chamber 14 that is formed in the shape of single-loop helix that has a first outlet end 16 that opens above the disk 10 and descends downwardly and terminates at a second inlet end 18 located below the level of the disk 10 but radially closely adjacent the first outlet end 16. The liquid chamber 14 is a closed tube, except for its two ends. A vent chamber 20 is also a single-loop helix that begins at a first inlet end 22 located above the plate 10 and diametrically opposite the first end 16 of the liquid chamber 14. The vent chamber 20 then also descends in helical fashion to its terminus at a second outlet end 24 located below the plane of the plate 10 and radially closely adjacent the first inlet end 22 of the vent chamber. The embodiment of the lid pictured in FIGS. 1 and 2 shows raised mouth portions 26 and 28, formed, respectively, on the first outlet end 16 of the liquid chamber 14 and the first inlet end 22 of the vent chamber 20.

Figure 2:
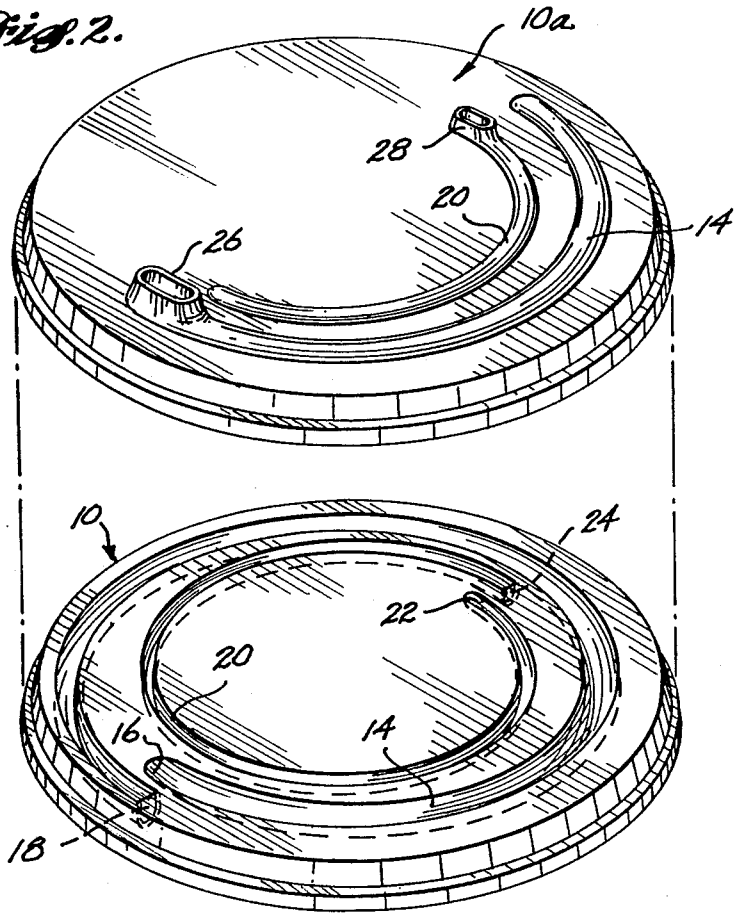
FIG. 2 is an exploded isometric view of the lid of FIG. 1.

FIG. 2 is an exploded isometric view of the lid of FIG. 1 showing the lid as constructed in two sections, the first section **10*a* including the first ends of both the liquid chamber 14 and the vent chamber 20, and the lower portion 10*b* including the second ends of the vent chamber 20 and the liquid chamber 14. Approximately one-half of each of the chambers is located in the upper and lower portions, respectively, so that when they are joined together the continuous tubular liquid chamber 14 and the continuous tubular vent chamber 20** are formed.

In operation, a user would place the lid over the open end of a container and, when he desired to drink from the container, he would place his lips over the first outlet end 16 of the liquid chamber 14 and produce a suction with his mouth, tilting the cup so that the liquid was adjacent the second inlet end 18 of the liquid chamber. The sucking action by the user would act to move the liquid through the liquid chamber 14 and into the mouth of the user, much like the action of a straw. At the same time, air would be able to enter the container through the inlet 22 of the vent chamber to prevent a vacuum from forming within the container. The major benefit of the lid of FIGS. 1 and 2 is that when the cup is in a horizontal position, such as if it were accidentally knocked on its side, liquid would enter the second inlet end 18 of the liquid chamber 14 and the second outlet end 24 of the vent chamber 20, but would only rise within the respective chambers to a level the same as the level of liquid within the cup. The liquid will not fill the entire length of either of the chambers and, therefore, will not be able to exit the cup. Thus, spilling of the liquid is prevented, except for some minor spillage that may occur from liquid that may have already been contained within one of the chambers when the cup was tipped over. Due to the descending helical configuration of the chambers, any liquid in the chambers will drain back into the cup each time the cup is placed in the upright position, so even minor spillage is eliminated.

In the preferred embodiment pictured in FIGS. 1 and 2, the liquid chamber 14 is larger in cross section than the vent chamber 20 and the inlet opening at the first end 22 of the vent chamber is smaller than the outlet opening at the first end 16 of the liquid chamber. In a situation where the liquid within the container is of comfortable temperature, typically, the user would use the larger opening in the larger chamber in order to obtain more liquid in a shorter time from the cup. However, if the liquid within the container were too hot to be comfortably drunk, the smaller vent chamber 20 could actually be used to extract liquid from within the container in smaller quantities so that the user does not burn his mouth. Also, the helical path that the liquid must follow as it exits the container provides some radiational cooling of the liquid as it travels through the chamber so that the liquid exiting the vent chamber would be at least somewhat cooler than the liquid entering the chamber directly from the container. The use of the terms "liquid" and "vent chamber" and the designation "inlet" or "outlet" for each end of the respective chamber is therefore arbitrary and, in fact, the chamber 20 can be used to extract liquid and the chamber 14 used to vent the container, if the user so desires.

Figure 4:
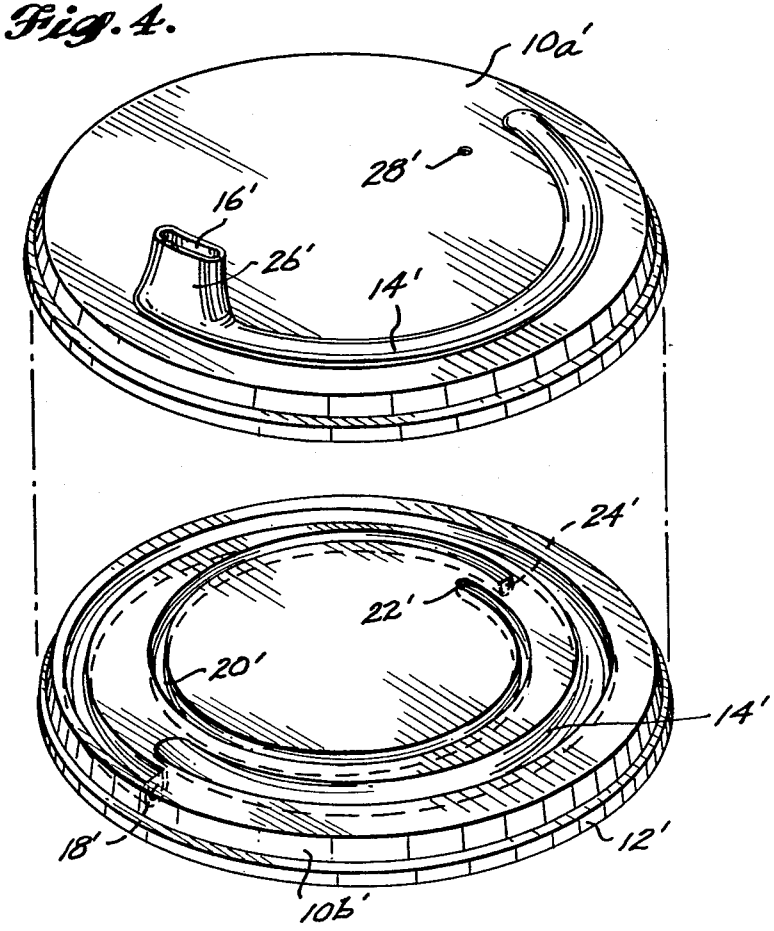
FIG. 4 is an exploded isometric view of the lid of FIG. 3.
Figure 3:
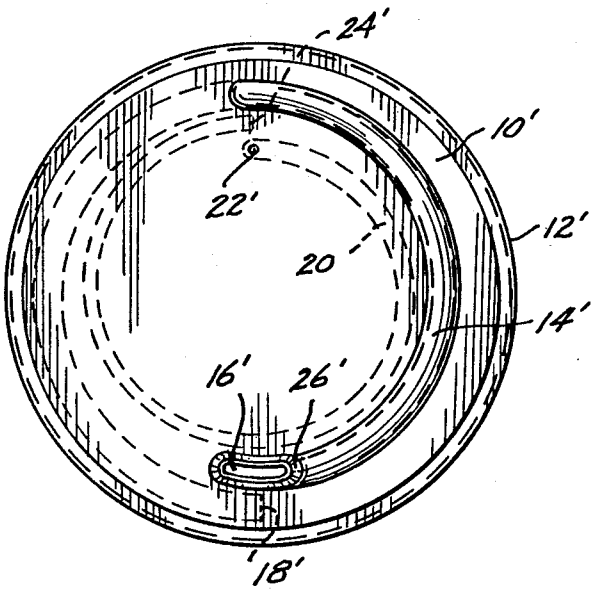
FIG. 3 is a top plan view of a second embodiment of the lid made in accordance with the present invention.

FIGS. 3 and 4 show a second embodiment of the invention that is very similar to the first embodiment, except in the configuration of the mouthpiece 26' at the first end 16' of the liquid chamber 14' and the elimination of any mouthpiece at the first end 22' of the vent chamber 20'. It can be seen that the mouthpiece 26' at the first end of the liquid chamber 14' is longer and extends higher above the lid, while the opening at the first end 22' of the vent chamber 20' is simply a hole 28' formed in the plate 10a'. The lid of FIGS. 3 and 4 is intended for use as a lid for a baby's cup and the tall mouthpiece 26' makes it easier for the baby to extract liquid by placing its mouth over the mouthpiece 26'. The lack of a second mouthpiece means that the baby will use the liquid chamber mouthpiece exclusively and will not have to make a decision as to which mouthpiece to use. Typically, the liquids in a baby's cup would be tested by one of its parents prior to consumption by the baby and, therefore, the advantage of hot and cold alternatives for drinking out of the cup is not as important.

While preferred embodiments of the invention have been discussed and illustrated, it should be understood by those of ordinary skill in the art and others that changes can be made to the illustrated embodiments without departing from the spirit and scope of the present invention. For example, while circular lids are shown, it would be possible to utilize the principles of this invention with a lid that was square or rectangular or of other geometrical shape. Also, while the chambers are essentially circular in plan view, any shape can be used as long as the chamber extends from one edge of the lid, across the lid, and back again to achieve the spill-proof characteristics. While the illustrated liquid chambers descend from the outlet to inlet ends, it would be possible to have the chambers in a flat plane as well. Also, while the lid is shown as being constructed of two separate pieces, the operation of the lid would not be affected if it were constructed in one single piece, although that would most likely involve complex manufacturing processes. Since such changes can be made to the illustrated embodiments while remaining within the scope of the invention, the invention should be defined solely with reference to the appended claims.

The embodiments of the invention in which an exclusive property or privilege is claimed are defined as follows:

1. A spill-proof lid for sealingly engaging the open end of a container, said lid including:

a cover plate for covering the open end of the container, said cover plate having a peripheral edge and the area of the plate including a first half and a second half;

a liquid chamber formed in said plate, having an inlet at a first end thereof and an outlet at the second end thereof, said inlet and outlet constructed and arranged such that when said lid is on said container, said inlet communicates with the interior of said container and said outlet communicates with the space outside said container, said inlet and said outlet both located in said first half of said plate, and said chamber extending from said inlet to a point in said second half of said plate and then to said outlet; and a vent chamber formed in said plate, said vent chamber having an inlet at a first end thereof and an outlet at a second end thereof, said inlet and outlet constructed and arranged such that when said lid is on said container said inlet communicates with the space outside said container and said outlet communicates with the interior of said container, said inlet and said outlet both located in said second half of said plate and said vent chamber extending from said inlet to a point in said first half of said plate and then to said outlet.

2. The lid of claim 1, wherein the inlet of said liquid chamber is at a different level from said outlet and said liquid chamber is ramped as it extends from said inlet to said outlet.

3. The lid of claim 2, wherein the inlet of said vent chamber is at a different level from said outlet and said vent chamber is ramped as it extends from said inlet to said outlet.

4. The lid of claim 1, wherein said liquid and vent chambers are tubular.

5. The lid of claim 4, wherein the cross-sectional area of said liquid chamber is larger than the cross-sectional area of said vent chamber.

6. The lid of claim 1, wherein said plate is circular and said inlet and outlet of said liquid chamber are diametrically opposed to the inlet and outlet of said vent chamber.

7. The lid of claim 6, wherein said liquid chamber is a portion of a circle.

8. The lid of claim 7, wherein said vent chamber is a portion of a circle.

9. The lid of claim 8, wherein said liquid chamber and said vent chamber are concentric.

10. The lid of claim 1, wherein said inlet and outlet of said liquid chamber are adjacent the edge of said plate.

11. The lid of claim 10, wherein said inlet and outlet of said vent chamber are adjacent the edge of said plate.

12. A spill-proof lid for use with a container for liquids, said lid including:

a cover plate for covering an open end of said container, said plate having a periphery constructed to sealingly engage the wall of said container;

a tubular liquid chamber having an inlet end opening below the lower surface of said plate in communication with the interior of said container and an outlet end opening above an upper surface of said plate in communication with the space outside said container, said chamber being curvilinear as it extends between said inlet and said outlet; and a tubular vent chamber having an inlet end opening above an upper surface of said plate in communication with the space outside said container and an outlet end opening below a lower surface of said plate in communication with the interior of said container, said vent chamber being curvilinear as it extends from said inlet to said outlet.

13. The spill-proof lid of claim 12, wherein said liquid chamber is a single-loop helix and said vent chamber is a single-loop helix concentric with said liquid chamber.

14. The lid of claim 12, wherein the inlet and outlet of said liquid chamber are closely adjacent one another and the inlet and outlet of said vent chamber are closely adjacent one another but diametrically opposed to the inlet and outlet of said liquid chamber.

15. The lid of claim 12, wherein the volume of said liquid chamber is larger than the volume of said vent chamber.

16. The lid of claim 12, further including a mouthpiece in fluid communication with the outlet end of said liquid chamber, said mouthpiece extending above the plate.

17. The lid of claim 16, further including a second mouthpiece in fluid communication with said inlet end of said vent chamber, said second mouthpiece extending above said plate.

* * * * *